US009211479B2

(12) United States Patent
Miller

(10) Patent No.: US 9,211,479 B2
(45) Date of Patent: Dec. 15, 2015

(54) DOLL HAVING FASTENING SURFACE HEAD WITH INTERCHANGEABLE HAIR SECTIONS

(71) Applicant: Vivian Miller, Chicago, IL (US)

(72) Inventor: Vivian Miller, Chicago, IL (US)

( * ) Notice: Subject to any disclaimer, the term of this patent is extended or adjusted under 35 U.S.C. 154(b) by 19 days.

(21) Appl. No.: 14/153,021

(22) Filed: Jan. 11, 2014

(65) Prior Publication Data

US 2015/0196848 A1 Jul. 16, 2015

(51) Int. Cl.
*A63H 3/44* (2006.01)
*A63H 3/16* (2006.01)

(52) U.S. Cl.
CPC ... *A63H 3/44* (2013.01); *A63H 3/16* (2013.01)

(58) Field of Classification Search
USPC ..... 446/97, 100, 296, 319, 372, 394; 434/94
See application file for complete search history.

(56) References Cited

U.S. PATENT DOCUMENTS

| | | | | | |
|---|---|---|---|---|---|
| 3,385,305 | A | * | 5/1968 | Buzzelli | 132/105 |
| 3,458,943 | A | * | 8/1969 | Trowbridge | 434/94 |
| 3,495,603 | A | * | 2/1970 | Young, Jr. | 132/53 |
| 3,765,123 | A | * | 10/1973 | Terzian | 446/394 |
| 3,903,640 | A | | 9/1975 | Dunn | |
| 3,910,292 | A | * | 10/1975 | Izzo | 132/53 |
| 3,980,092 | A | * | 9/1976 | Garufi | 132/53 |
| 4,070,790 | A | | 1/1978 | Strongia et al. | |
| 4,317,462 | A | * | 3/1982 | Steiner | 132/213 |
| 4,370,137 | A | * | 1/1983 | Herzig et al. | 434/94 |
| 4,874,345 | A | | 10/1989 | Dirks | |
| 5,041,050 | A | * | 8/1991 | Ritchey et al. | 446/394 |
| 5,252,074 | A | * | 10/1993 | Passage et al. | 434/94 |
| 5,299,968 | A | * | 4/1994 | Bennett | 446/394 |
| 5,592,957 | A | * | 1/1997 | Gazerro et al. | 132/53 |
| 6,012,460 | A | * | 1/2000 | Kikuchi | 132/53 |
| 6,120,340 | A | | 9/2000 | Zaborowski | |
| 6,527,618 | B1 | * | 3/2003 | Faunda et al. | 446/394 |
| 7,252,093 | B2 | * | 8/2007 | Rodriguez | A41G 5/0046 132/201 |
| 7,410,358 | B2 | * | 8/2008 | Morehead | 434/94 |
| 8,602,835 | B1 | * | 12/2013 | Zwiers et al. | 446/394 |
| 2002/0166565 | A1 | * | 11/2002 | Whitfield | A41G 3/0041 132/54 |
| 2006/0008780 | A1 | * | 1/2006 | Pang | 434/94 |
| 2009/0056730 | A1 | * | 3/2009 | Wilson | A61F 2/10 132/53 |

FOREIGN PATENT DOCUMENTS

| | | |
|---|---|---|
| FR | 993784 | 7/1951 |

* cited by examiner

*Primary Examiner* — Kurt Fernstrom
(74) *Attorney, Agent, or Firm* — The Keys Law Firm PLLC

(57) ABSTRACT

An interchangeable hair doll for enabling a plurality of different hair styles, textures, and colors to be worn as releasably attached hair parts comprises a modified doll head and a plurality of discrete hair parts which employ a hook and loop fastener. The modified doll head includes a hair fastening surface defined by a layer of a hook component material which covers the entire scalp area of the head. Each individual hair part includes three discrete hair tracks permanently attached at one end to one side of a fastening strip in a bottom up, sequential orientation so as to obscure from view the side of the fastening strip to which the hair tracks are attached. The other side of the fastening strip defined by layer of a loop component material. The loop component enables the hair parts to be removably attached to any area of the hair fastening surface.

19 Claims, 2 Drawing Sheets

DOLL HAVING FASTENING SURFACE HEAD WITH INTERCHANGEABLE HAIR SECTIONS

BACKGROUND OF THE INVENTION

1. Field of the Invention

This invention relates generally to dolls having hair for styling and, more particularly, to a doll configured to wear hair in a plurality of different styles, textures, and colors through the utilization of releasably attached hair sections.

2. Description of the Prior Art

The use of dolls by humans is believed to date back at least as early as 2000 B.C. and continues to this very day. Throughout that time, dolls have been used in cultures all over the world for many different purposes. The use of dolls as a toy for children is well established; so much so that it is a commonly thought circles that dolls may be the oldest known toy. It is also well known that dolls have been used in magic and religious rituals throughout the world for centuries. In more recent times, dolls have additionally been made as artistic pieces or made for collectible purposes.

In modern times, typical dolls are provided with artificial hair which has been permanently attached to the scalp area of the doll's head. In many cases, this hair is adapted to enable a user to style it in various desired styles. Indeed, styling head dolls, whether embodied as a doll having a full body or as a doll having just a head and/or upper body area, are common and are even provided with various hair styling accessories that are sized and/or otherwise adapted for use in styling the doll's hair.

A problem which exists, however, is that the hair on typical dolls, including styling head dolls, is usually permanently attached cannot be changed or otherwise substituted. Consequently, such permanent hair dolls lack any capacity to readily and easily change the doll's hair color or texture, or even to make more substantial changes to the doll's hair style. Furthermore, because the hair on such permanent hair dolls is subjected to repeated re-styling, the quality of the hair will often degrade over time. Such degradation can lead to the hair becoming tangled, matted, and otherwise no longer useable for styling purposes. In light of such issues, attempts have been made to address the problem created by permanent hair dolls.

French Patent No. 993,784, issued on Jul. 11, 1951 to Hatik, discloses a doll having a wig which fastens to the doll's head by way of elastic members as opposed to adhesive and is removable and interchangeable.

U.S. Pat. No. 3,903,640, issued on Sep. 9, 1975 to Dunn, discloses a doll structured for changing the appearance of the doll by changing the color and/or style of her hair.

U.S. Pat. No. 4,070,790, issued on Jan. 31, 1978 to Strongin et al., discloses a doll is with a doll head adapted to receive and releasably mount interchangeable hair pieces through a plastic clip covered with a fastening surface and mounted in a groove on the head and a separate hair piece having a complementary fastening surface.

U.S. Pat. No. 4,874,345, issued on Oct. 17, 1989 to Dirks, discloses a doll with a doll head for releasably mounting changeable hair piece thereon by way of a suction cup mechanism.

U.S. Pat. No. 6,120,340, issued on Sep. 19, 2000 to Zaborowski, discloses a stuffed animal toy with a removable head covering accessory such as a hairpiece, a wig or a hat.

Despite such attempts to address the problem created by permanent hair dolls, there remains a need for a doll having a head with a fastening surface and corresponding hair sections having a fastening surface for removably attaching thereto. It would be helpful if such an interchangeable hair doll was structured to provide a fastening surface which covered the entire scalp area of the doll head. It would be also desirable for such an interchangeable hair doll utilized a plurality of discrete hair sections which can be oriented as desired by a user on the scalp area of the doll head. It would be additionally desirable for such the plurality of discrete hair sections on the interchangeable hair doll to be adapted to be independently fastened to the scalp area of the doll head.

The Applicant's invention described herein provides for a doll with a head adapted to enable removably attachable hair parts to be secured thereto. The primary components of Applicant's interchangeable hair doll include a doll and a plurality of removably attachable hair parts. When in use, the interchangeable hair doll allows a user to change the doll's hair color or texture, make substantial changes to the doll's hair style or length, or replace existing hair by simply detaching existing hair parts and attaching desired hair parts. As a result, many of the limitations imposed in the prior art are removed.

SUMMARY OF THE INVENTION

An interchangeable hair doll for enabling hair in a plurality of different styles, textures, and colors to be worn as releasably attached hair parts comprises a modified doll head and a plurality of discrete hair parts. The modified doll head is defined by a head dolls, whether embodied as a doll having a full body or as a doll having just a head and/or upper body area, having a hair fastening surface which covers the entire scalp area of the head. The hair fastening surface is defined by a hook component surface, embodied as a layer of the hook aspect of a hook and loop fastener (such as Velcro®). In one embodiment, the hook component surface is embodied as a layer of material which is permanently attached to the doll head by way of an adhesive. In other embodiment, the hook component surface may be integrated with the doll head.

Each individual hair part includes three discrete hair tracks permanently attached at one end to one side of a fastening strip. The three hair tracks are attached to the fastening strip in a bottom up, sequential orientation so as to obscure from view the side of the fastening strip to which the hair tracks are attached. The side of the fastening strip opposite the hair tracks is defined by a loop component surface embodied as a layer of the loop aspect of the hook and loop fastener. This loop component surface enables the hair part to be removably attached to any area of hook component surface on an accompanying modified doll head by simply pressing it against the desired area of the hook component surface.

It is an object of this invention to provide a doll having a head with a fastening surface and corresponding hair sections having a fastening surface for removably attaching thereto.

It is another object of this invention to provide an interchangeable hair doll structured to provide a fastening surface which covered the entire scalp area of the doll head.

It is yet another object of this invention to provide an interchangeable hair doll which utilized a plurality of discrete hair sections which can be oriented as desired by a user on the scalp area of the doll head.

It is still another object of this invention to provide an interchangeable hair doll which utilized a plurality of discrete hair sections on the interchangeable hair doll to be adapted to be independently fastened to the scalp area of the doll head These and other objects will be apparent to one of skill in the art.

DETAILED DESCRIPTION OF THE INVENTION

Figure 1A:
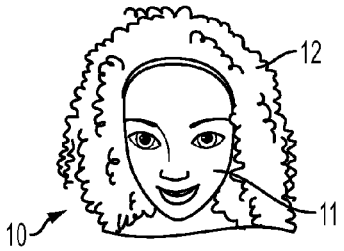
FIG. 1*a* shows a front elevational view of an interchangeable hair doll built in accordance with the present invention.
Figure 1B:
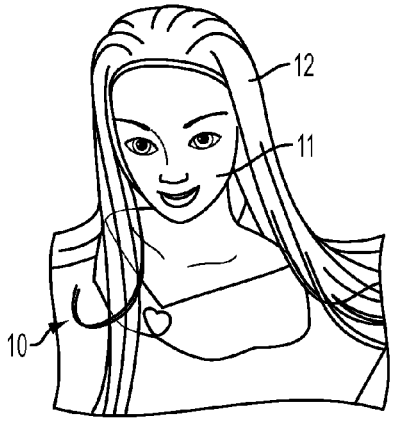
FIG. 1*b* shows a front perspective view of an interchangeable hair doll built in accordance with the present invention.

Referring now to the drawings and in particular FIGS. 1*a* and 1*b*, an interchangeable hair doll 10 is shown as a modified doll head 11 having a plurality of hair parts 12 attached thereto. The modified doll head 11 in FIGS. 1*a* and 1*b* are identical. The difference in the appearance in the interchangeable hair doll 10 in FIG. 1*a* and FIG. 1*b* is entirely attributable to the plurality of hair parts 12 which are in place on the modified doll head 11, in that the plurality of hair parts 12 on FIG. 1*a* include hair of a different color, different texture, and in a different style than that of the plurality of hair parts 12 in FIG. 1*b*.

Figure 2A:
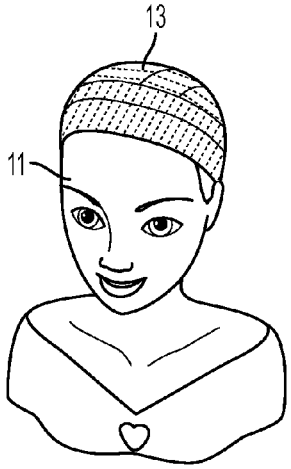
FIG. 2*a* shows a front elevational view of a modified doll head of an interchangeable hair doll built in accordance with the present invention.
Figure 2B:
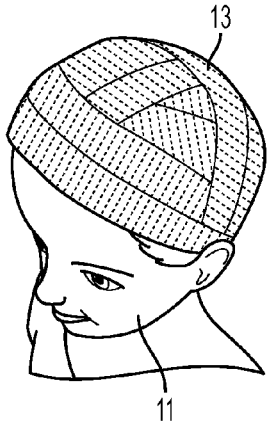
FIG. 2*b* shows a front perspective view of a modified doll head of an interchangeable hair doll built in accordance with the present invention.

Referring now to FIGS. 2*a* and 2*b*, the modified doll head 11 is shown without any hair parts attached. The modified doll head 11 is defined by the presence of a hair fastening surface 13, which covers the entire scalp area of the head. In this regard, the hair fastening surface 13 is disposed on the modified doll head 11 in the areas where head hair would be on conventional doll heads (not shown) and on generally on a human head. In the preferred embodiment, a hook component surface, embodied as a layer of the hook aspect of a hook and loop fastener system, defines the side of the hair fastening surface 13 which does not contact the modified doll head 11. The opposite side of the hair fastening surface 13, which contacts the modified doll head 11, is affixed to the modified doll head 11 by way of an adhesive, resulting in the permanent attachment of the hair fastening surface 13 to the modified doll head 11.

Figure 3:
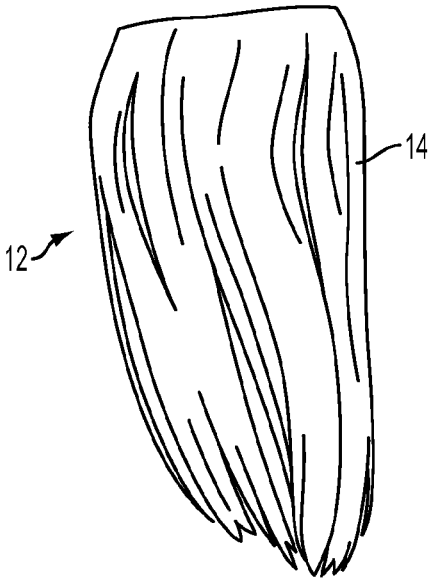
FIG. 3 shows a top plan view of a hair part of an interchangeable hair doll built in accordance with the present invention.
Figure 4:
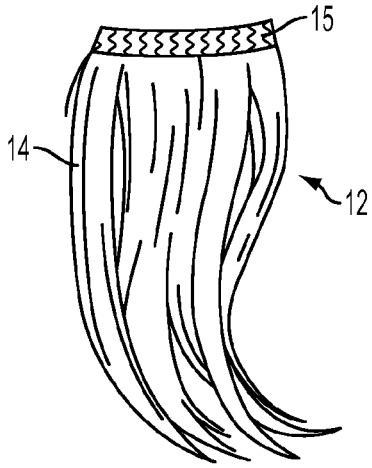
FIG. 4 shows bottom plan view of a hair part of an interchangeable hair doll built in accordance with the present invention.
Figure 5:
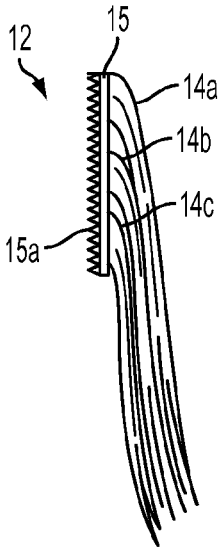
FIG. 5 shows side elevational view of a cross section of a hair part of an interchangeable hair doll built in accordance with the present invention.

Referring now to FIGS. 3, 4 and 5, an individual hair part 12 is shown as a plurality of discrete hair tracks 14*a*, 14*b*, 14*c* (collectively, 14) permanently attached to a fastening strip 15. Each discrete hair track 14 is defined by a strip of hair which is configured to be utilized in hair styling. At one end, each discrete hair track 14 is permanently attached to one side of the fastening strip 15. In the preferred embodiment, all three hair tracks 14 are attached to the fastening strip 15 in a bottom up, sequential orientation. Consequently, when all three hair tracks 14 are in place on the fastening strip 15, whenever the hair part 12 is viewed from the top, only the hair of the hair tracks 14 is visible. In an alternate embodiment, an individual hair part is defined by four or more discrete hair tracks are permanently attached at one end to one side of a fastening strip.

The other side of the fastening strip 15, opposite the side where the hair tracks 14 are attached, is defined by a loop component surface 15*a*, embodied as a layer of the loop aspect of a hook and loop fastener system, which enables the hair part 12 to be removably attached to any area of hook component surface of a modified doll head built in accordance with the present invention.

Figure 6:
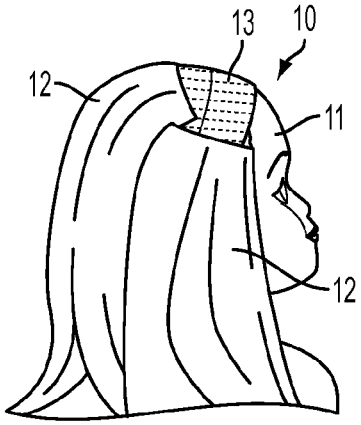
FIG. 6 shows a side elevational view of an interchangeable hair doll built in accordance with the present invention having its hair parts partially installed.

Referring now to FIG. 6, the modified doll head 11 of an interchangeable hair doll 10 is shown with a plurality of discrete hair parts 12 attached thereto. The hair parts 12 are each attached to the modified doll head 11 by way of the hair parts' 12 respective loop component surface on the fastening strip and the modified doll head's hair fastening surface. In this regard, each hair part 12 is attached individually and in a desired location and orientation, through the act of manually pressing the loop component surface on the fastening strip of a particular hair part 12 on and against the hair fastening surface in a desired location, with the hair part 12 oriented as desired. The manual pressure causes the loop component surface to engage the hook component surface of the hair fastening surface, which in turn results in the hair part 12 being removably attached to the modified doll head 11. While a partial installation of a plurality of hair parts 12 is shown, it is contemplated that a full installation of hair parts 12 would include additional hair parts 12 attached to the modified doll head 11 in such a manner that substantially all of the hair fastening surface was engaged with a fastening strip.

The removable attachment of hair parts enables the hair of an interchangeable hair doll built in accordance with the present invention to be removed and replaced with other hair parts as desired by the end user. As the hair parts are defined by the permanent attachment of hair strips or tracks to a fastening strip having a loop fastening component, and not the color, texture or style of the hair strips or tracks, it is understood that the use of such removably attachable hair parts enables an end user to quickly and easily make substantial changes to the color of the hair in place on Applicant's interchangeable hair doll, its texture, and/or its style, all without any risk of damaging interchangeable hair doll or its hair. Furthermore, if the quality hair on a particularly desired hair part built in accordance with the present invention begins to degrade, becomes tangled or matted, or is otherwise no longer useable, it can simply be discarded and replaced with a new hair part having the same characteristics.

The assembly of an interchangeable hair doll begins by taking a convention doll head and removing the hair. Once the hair is removed, a plurality of hook fastener pieces, defined by the presence of the hook aspect of a hook and loop fastener system on one side, are permanently attached to the doll head sufficient to cover the scalp area from which the hair was removed. In the preferred embodiment, each hook fastener piece includes a adhesive coating on the side opposite the hook aspect which enables such permanent attachment. In an alternate embodiment, an adhesive is applied to the side opposite the hook aspect and/or the doll head to enable such permanent attachment. The plurality of hook fastener pieces combine to form a hook component surface on the doll head.

In addition to the assembly of the doll head to include its hook component surface, each hair part must be assembled. The assembly of each hair part begins with configuring a plurality of hair strips (or tracks) for permanent attachment to a fastening strip. Such configuration includes sorting hair strips by color, texture and style as in the preferred embodiment, each discrete hair part employs a single hair style, color and texture. It is contemplated that while it is intended for the interchangeable hair doll to enable mixing and matching of textures, colors and styles, such mixing and matching is enabled through using a plurality of hair parts having different textures, colors and styles.

The configuration of hair strips additionally includes measuring and cutting each hair strip, as necessary, so that the width of each hair strip is substantially the same width as the targeted fastening strip for it to be attached to. Once configured, each hair strip is permanently attached in sequence from bottom to top, to its targeted fastening strip. It is contemplated that an adhesive may be employed to permanently attach the hair strips, but if desired, the hair strips may be sewn to the fastening strip. When all three hair strips are attached to the fastening strip, the hair part is assembled and ready for removable attachment to a modified doll head built in accordance with the present invention.

It is contemplated that because of the nature of the hair part fastening employed in the present invention, and particularly, the use of a combination of readily available components such as loop fastener material, hair tracks, and an adhesive, end users would be able to create custom or replacement hair parts as desired.

It is additionally contemplated that loop fasteners are preferred on for the fastener component of the hair strip's fastening pieces because the fastening strip of the hair parts is likely to be handled or contacted by a user much more often than the hair fastening surface.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An interchangeable hair doll, comprising:

at least one hair part, wherein each at least one hair part is defined by a plurality of discrete strips of hair permanently attached to a fastening strip having a first strip side and a second strip side; and a modified doll head defined by a conventional doll head configured with a hair fastening surface having a first surface side defining its scalp area, wherein said first strip side of the fastening strip of each at least one hair part is configured to engage the first surface side of said hair fastening surface in a manner which causes its corresponding hair part to be releasably attached to said modified doll head.

2. The interchangeable hair doll of claim 1, wherein a plurality of hair parts are provided and the fastening strips are sized relative to the hair fastening surface to require multiple discrete fastening strips to be engaged on different sections of the hair fastening surface for the hair fastening surface to be substantially covered in its entirety.

3. The interchangeable hair doll of claim 1, wherein each at least one hair part is defined by three discrete strips of hair permanently attached to the second strip side.

4. The interchangeable hair doll of claim 1, wherein:

the first strip side is defined by a loop component surface embodied as a layer the loop aspect of a hook and loop fastener system; and the first surface side is defined by a hook component surface embodied as a layer of the hook aspect of a hook and loop fastener system.

5. The interchangeable hair doll of claim 1, wherein said hair fastening surface additionally includes a second surface side opposing the first surface side.

6. The interchangeable hair doll of claim 5, wherein the conventional doll head is configured with the hair fastening surface through the second surface side being permanently attached to the scalp area of the conventional doll head.

7. The interchangeable hair doll of claim 5, wherein the second surface side is permanently attached to the scalp area of the conventional doll head through an adhesive.

8. The interchangeable hair doll of claim 1, wherein each of said strips of hair is permanently attached to said the fastening strip of the hair part through an adhesive.

9. The interchangeable hair doll of claim 1, wherein each of said strips of hair is permanently attached to said the fastening strip of the hair part through stitching.

10. A method of customizing the hair on an interchangeable hair doll, comprising the steps of:

providing at least one hair part, wherein each at least one hair part is defined by a plurality of discrete strips of hair permanently attached to a fastening strip having a first strip side and a second strip side;

providing a modified doll head defined by a conventional doll head configured with a hair fastening surface having a first surface side defining its scalp area; and engaging the first strip side of the fastening strip of each at least one hair part with the first surface side of said hair fastening surface, wherein said first strip side and said first surface side are configured to fasten together when engaged, forming a releasable attachment between the hair part corresponding to the engaged fastening strip and said modified doll head.

11. The method of claim 10, wherein a plurality of hair parts are provided and the fastening strips are sized relative to the hair fastening surface to require multiple discrete fastening strips to be engaged on different sections of the hair fastening surface for the hair fastening surface to be substantially covered in its entirety.

12. The method of claim 10, wherein each at least one hair part is defined by three of said strips of hair permanently attached to the second strip side in a manner which covers the first strip side, obscuring it from sight.

13. The method of claim 10, wherein:

the first strip side is defined by a loop component surface embodied as a layer the loop aspect of a hook and loop fastener system; and the first surface side is defined by a hook component surface embodied as a layer of the hook aspect of a hook and loop fastener system.

14. The method of claim 10, wherein said hair fastening surface additionally includes a second surface side opposing the first surface side.

15. The method of claim 14, wherein the conventional doll head is configured with the hair fastening surface through the second surface side being permanently attached to the scalp area of the conventional doll head.

16. The method of claim 14, wherein the second surface side is permanently attached to the scalp area of the conventional doll head through an adhesive.

17. The method of claim 10, wherein each of said strips of hair is permanently attached to said the fastening strip of the hair part through an adhesive.

18. The method of claim 10, wherein each of said strips of hair is permanently attached to said the fastening strip of the hair part through stitching.

19. An interchangeable hair doll, comprising:

a plurality of discrete hair parts, wherein each hair part is defined by three discrete strips of hair permanently attached to a fastening strip having a first strip side and a second strip side, with the strips of hair attached to the second strip side through at least one of stitching and an adhesive;

wherein the fastening strips are sized relative to the hair fastening surface to require multiple discrete fastening strips to be engaged on different sections of the hair fastening surface for the hair fastening surface to be substantially covered in its entirety a modified doll head defined by a conventional doll head configured with a hair fastening surface having a first surface side and a second surface side defining its scalp area, wherein said first strip side of the fastening strip of each hair part is defined by a loop component surface embodied as a layer the loop aspect of a hook and loop fastener system and configured to engage the first surface side of said hair fastening surface, defined by a hook component surface embodied as a layer of the hook aspect of a hook and loop fastener system, in a manner which causes its corresponding hair part to be releasably attached to said modified doll head; and wherein the conventional doll head is configured with the hair fastening surface through the second surface side being permanently attached to the scalp area of the conventional doll head through an adhesive.

* * * * *